US011255532B1

(12) United States Patent
Tong

(10) Patent No.: US 11,255,532 B1
(45) Date of Patent: Feb. 22, 2022

(54) USER-DEFINED FESTOON LAMP COMPONENT

(71) Applicant: Kwong Sai Tong, Dongguan (CN)

(72) Inventor: Kwong Sai Tong, Dongguan (CN)

(73) Assignee: Dongguan Jiedu Electronic Technology Company Limited, Dongguan (CN)

( * ) Notice: Subject to any disclaimer, the term of this patent is extended or adjusted under 35 U.S.C. 154(b) by 0 days.

(21) Appl. No.: 17/234,735

(22) Filed: Apr. 19, 2021

(51) Int. Cl.

| | |
|---|---|
| ***F21V 23/04*** | (2006.01) |
| ***F21V 23/02*** | (2006.01) |
| ***F21V 7/04*** | (2006.01) |
| ***F21S 9/02*** | (2006.01) |
| ***F21V 17/16*** | (2006.01) |
| ***F21Y 113/10*** | (2016.01) |
| ***F21Y 115/10*** | (2016.01) |

(52) U.S. Cl.
CPC ..... *F21V 23/0435* (2013.01); *F21S 9/02* (2013.01); *F21V 7/04* (2013.01); *F21V 17/16* (2013.01); *F21V 23/023* (2013.01); *F21V 23/045* (2013.01); *F21Y 2113/10* (2016.08); *F21Y 2115/10* (2016.08)

(58) Field of Classification Search
CPC .... F21S 9/02; F21V 7/04; F21V 17/16; F21V 23/02–06; F21Y 2113/10; F21Y 2115/10
USPC ..... 362/249.02, 311.02
See application file for complete search history.

(56) References Cited

U.S. PATENT DOCUMENTS

| | | | | |
|---|---|---|---|---|
| 7,802,903 | B1 * | 9/2010 | Wray | F21K 9/278 362/249.02 |
| 9,491,826 | B2 * | 11/2016 | Altamura | H05B 45/20 |
| 2014/0218955 | A1 * | 8/2014 | Lee | H05B 47/12 362/552 |

* cited by examiner

*Primary Examiner* — Jason M Han

(57) ABSTRACT

A user-defined festoon lamp component, including a festoon lamp and a remote controller adapted to the festoon lamp. The festoon lamp includes a first MCU and a wireless receiving unit electrically connected to the first MCU, a first power supply unit, a white light LED unit and an RGB LED unit. The remote controller includes a second MCU and a wireless transmitting unit electrically connected to the second MCU, a second power supply unit and a button matrix unit for controlling the luminescent state of the white light LED unit and RGB LED unit. The festoon lamp is electrically connected to the wireless transmitting unit of remote controller through the wireless receiving unit. The button matrix unit includes an R button, a G button and a B button for independently increasing the R color, G color and B color in RGB LED unit.

8 Claims, 9 Drawing Sheets

USER-DEFINED FESTOON LAMP COMPONENT

BACKGROUND OF INVENTION

1. Field of the Invention

The present invention relates generally to the technical field of lamp products, and more particularly to a user-defined festoon lamp component.

2. Description of Related Art

The LED is the abbreviation for Light Emitting Diode, it is an electronic device which can convert electric energy into light energy, and it has the characteristics of diode. LED is known as the fourth generation light source, characterized by energy saving, environmental protection, safety, long life, low power consumption, low heat, high luminance, water resistance, miniature, shock resistance, easy dimming, concentrated light beam and convenient maintenance. It can be extensively used in the domains of indication, display, decoration, back light source and general lighting.

The RGB LED can be used for effect lighting. This kind of LED uses three chips, each chip generates a color light (red, green and blue). Another method to generate different color lights is to use red, green and blue monochromatic LEDs, and then the light rays from these LEDs are mixed and exported. Comparatively, the RGB LED has better effect lighting, and its assembly is more convenient.

The variable color RGB LED festoon lamps on the present market include

1. Automatic combination: the RGB LED color-changing lamps are combined automatically according to the default program proportions. The problem and defect are that the user cannot freely prepare his favorite colors.

2. Prepared color combination, the user can choose the prepared colors, there are several to tens of prepared colors. Defect: the user cannot freely prepare his favorite colors.

3. The customer chooses a color preset on the surface of a fixed touch circuit board. Defect: the user cannot freely prepare his favorite colors.

In view of this, this inventor proposes the following technical proposal.

SUMMARY OF THE INVENTION

The purpose of the present invention is to overcome the shortcomings of the prior art and provide a user-defined festoon lamp component comprising: a festoon lamp (100) and a remote controller (200) adapted to the festoon lamp (100) for controlling the luminescent state of festoon lamp (100), wherein the festoon lamp (100) includes a first MCU (101), a wireless receiving unit (102) electrically connected to the first MCU (101), a first power supply unit (103), a white light LED unit (104), and an RGB LED unit (105); wherein the remote controller (200) includes a second MCU (201), a wireless transmitting unit (202) electrically connected to the second MCU (201), a second power supply unit (203), and a button matrix unit (204) for controlling the luminescent state of the white light LED unit (104) and RGB LED unit (105), the festoon lamp (100) is electrically connected to the wireless transmitting unit (202) of the remote controller (200) through the wireless receiving unit (102); the button matrix unit (204) includes an R button (2041) for independently increasing the R color in RGB LED unit (105), a G button (2042) for independently increasing the G color in RGB LED unit (105), and a B button (2043) for independently increasing the B color in RGB LED unit (105).

More particularly, wherein the button matrix unit (204) includes an ON button (2044), an OFF button (2045), an AUTO button (2046), a White button (2047), a brightness– button (2048), a brightness+ button (2049), a SET button (2040) and several time setting buttons (205), the ON button (2044), OFF button (2045), AUTO button (2046), White button (2047), brightness– button (2048), brightness+ button (2049), SET button (2040) and several time setting buttons (205) and the R button (2041), G button (2042) and B button (2043) are arranged on the casing (206) of the remote controller (200).

More particularly, wherein the festoon lamp (100) includes a lamp holder (1), a power supply (2) installed in the lamp holder (1) as the first power supply unit (103), a PCB (3) installed on the lamp holder (1), a plurality of white light LEDs (4) installed on an upper end face of PCB (3) as white light LED unit (104), a reflective cup (5) installed on the lamp holder (1) and fitted over the white light LEDs (4), a face cover (6) installed on lamp holder (1) and covering the reflective cup (5), and a lamp shade (7) passing through the face cover (6) and contacting an upper end of reflective cup (5), the upper end face of the PCB (3) is provided with several RGB LEDs (8) interlaced with white light LEDs (4) as RGB LED unit (105), the first MCU (101) and wireless receiving unit (102) are installed on PCB (3).

More particularly, wherein the PCB (3) is provided with a first LED driver module (33) for driving the white light LED (4) to emit light and the first, second and third LED driver modules (34, 35, 36) for jointly driving the RGB LED (8) to emit different color lights or gradient color light.

More particularly, wherein an outer side of the reflective cup (5) is provided with a plurality of downbent elastic arms of force (51), the elastic arm of force (51) is provided with a sleeve joint part (52), the sleeve joint part (52) is fitted over the guide column (11) formed on the lamp holder (1); wherein the sleeve joint part (52) is an unclosed sleeve joint collet, there is an opening in the periphery of the sleeve joint collet, the opening extends to the upper and lower ends of the sleeve joint collet.

More particularly, wherein an anti-disengagement flange (71) for preventing the lamp shade (7) from accidentally disengaging from the window (61) in the face cover (6) for the lamp shade (7) to pass through is formed outside a lower end of the lamp shade (7).

More particularly, wherein the reflective cup (5) is provided with a wireless receiver (53), the wireless receiver (53) is connected to the PCB (3) by conductor, the wireless receiver (53) is connected to the wireless receiving unit (102), the face cover (6) is provided with a light conduction base (62), the wireless receiver (53) passes through the light conduction base (62).

More particularly, wherein the festoon lamp (100) includes a lamp holder (1), a power supply (2) installed in the lamp holder (1) as the first power supply unit (103), a PCB (3) installed on the lamp holder (1), several RGB LEDs (8) installed on the upper end face of PCB (3) as the RGB LED unit (105), a face cover (6) buckled in an upper end of the lamp holder (1), a lamp shade (7) vertically movable on the face cover (6) and above the RGB LED (8), a bottom cover (13) installed at a lower end of the lamp holder (1), the PCB (3) is provided with a switch button (31), the side face of the lamp shade (7) forms an anti-disengagement buckle (72) at an upper end of the switch button (31), when the lamp shade (7) is pressed, the anti-disengagement buckle (72)

presses the switch button (31) to actuate the switch button (31), an inner flange (600) is integrally formed at an upper end of the face cover (6), the inner flange (600) has a window (601), the RGB LED (8) is placed in the window (601), the first MCU (101) and wireless receiving unit (102) are installed on the PCB (3).

More particularly, wherein the PCB (3) is provided with an IR sensor (32) as the wireless receiving unit (102), the IR sensor (32) is located under the lamp shade (7), the face cover (6) covers the upper end of the lamp holder (1), the bottom cover (13) covers the lower end of the lamp holder (1), and a lower end face of the face cover (6) contacts an upper end face of the bottom cover (13).

More particularly, wherein a storage slot (63) is formed in the upper end of the face cover (6), and an anti-disengagement hole (64) is formed in the inner wall of the storage slot (63), the storage slot (63) is located in an upper end of inner flange (600), the lamp shade (7) is installed in the storage slot (63), and an anti-disengagement buckle (72) formed on the side face of the lamp shade (7) is inserted into the anti-disengagement hole (64), a guide bar (65) is formed at the lower end of the face cover (6), a guide slot (13) is formed at the upper end of the lamp holder (1), the guide bar (65) is inserted into the guide slot (13).

After the technical proposal is used, in comparison to the existing technology, the present invention has the following beneficial effects. The present invention adds the RGB LED to the original LED lighting fixture, so as to implement effect lighting to meet different operating requirements. In addition, the R button, G button and B button on the remote controller can independently control the proportions of red, green and blue lights in the RGB LED unit, the user's favorite color light is assembled by free combination, the operation is very convenient and flexible, so that the present invention has very strong marketability. Moreover, the prepared adoption can be saved through the SET button for next or frequent use, the marketability of the present invention is further enhanced.

DETAILED DESCRIPTION OF THE INVENTION

The present invention is further described below with specific embodiments and attached figures.

Figure 1:
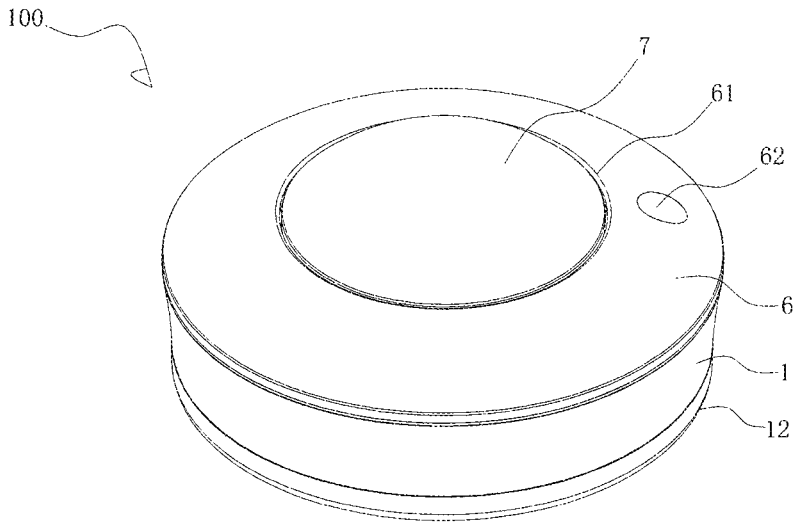
FIG. 1 is a stereogram of festoon lamp in Embodiment 1 of the present invention.
Figure 2:
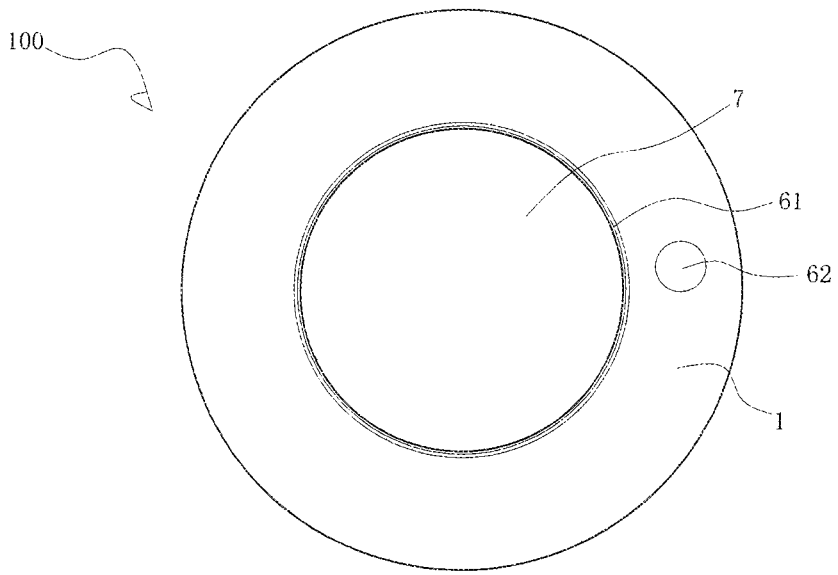
FIG. 2 is a front view of festoon lamp in Embodiment 1 of the present invention.
Figure 3:
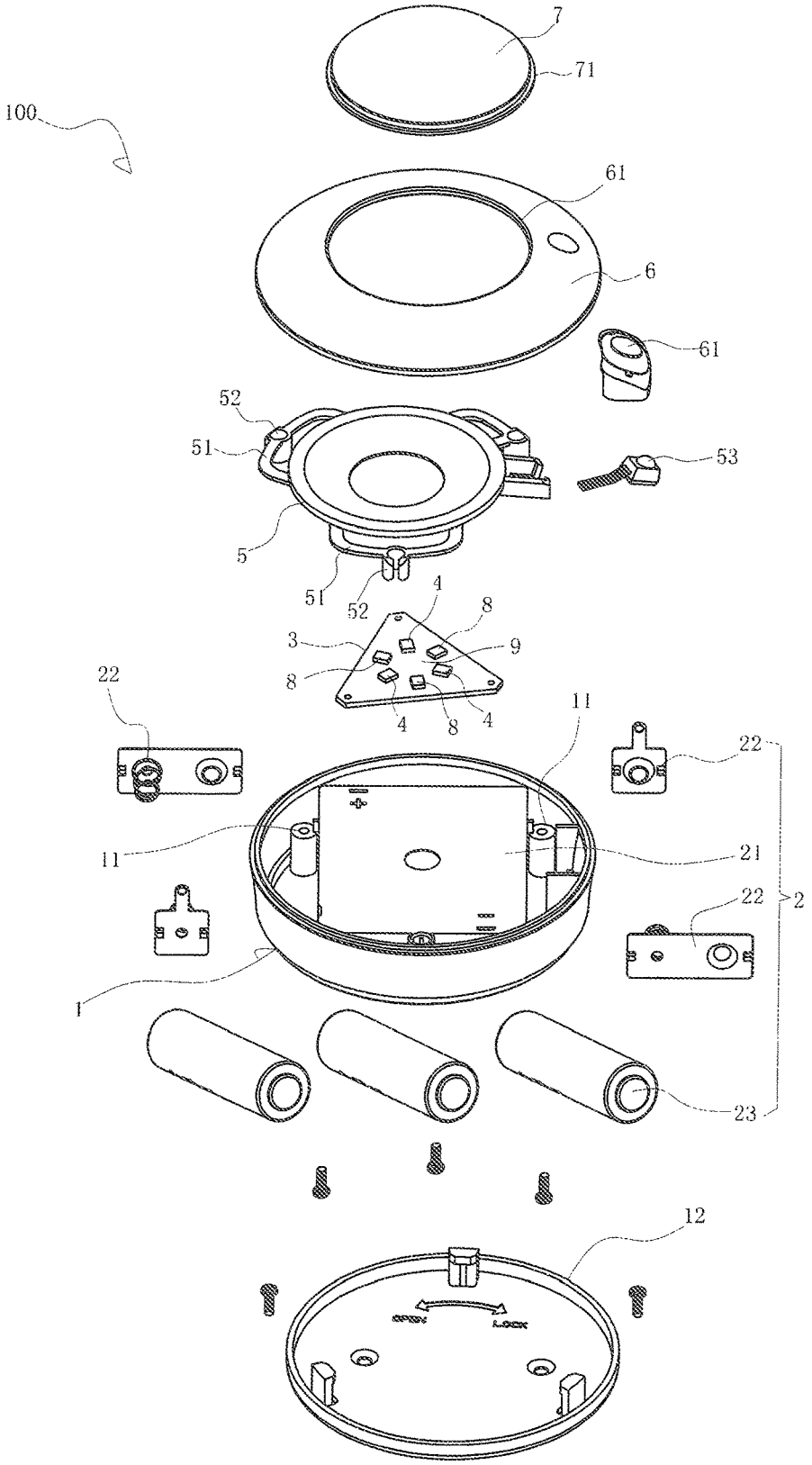
FIG. 3 is a three-dimensional exploded diagram of festoon lamp in Embodiment 1 of the present invention.
Figure 4:
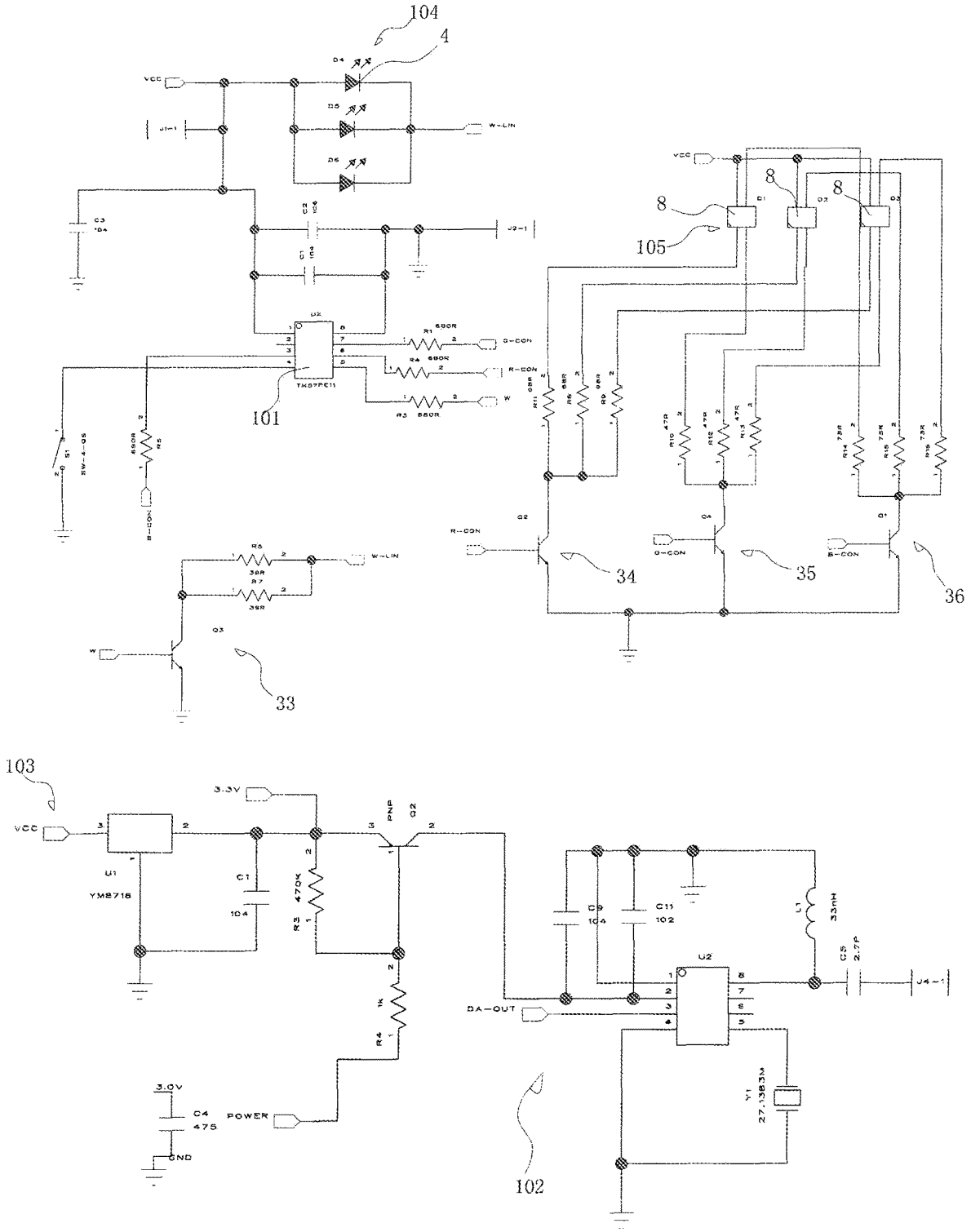
FIG. 4 is a circuit diagram of festoon lamp in Embodiment 1 of the present invention.
Figure 5:
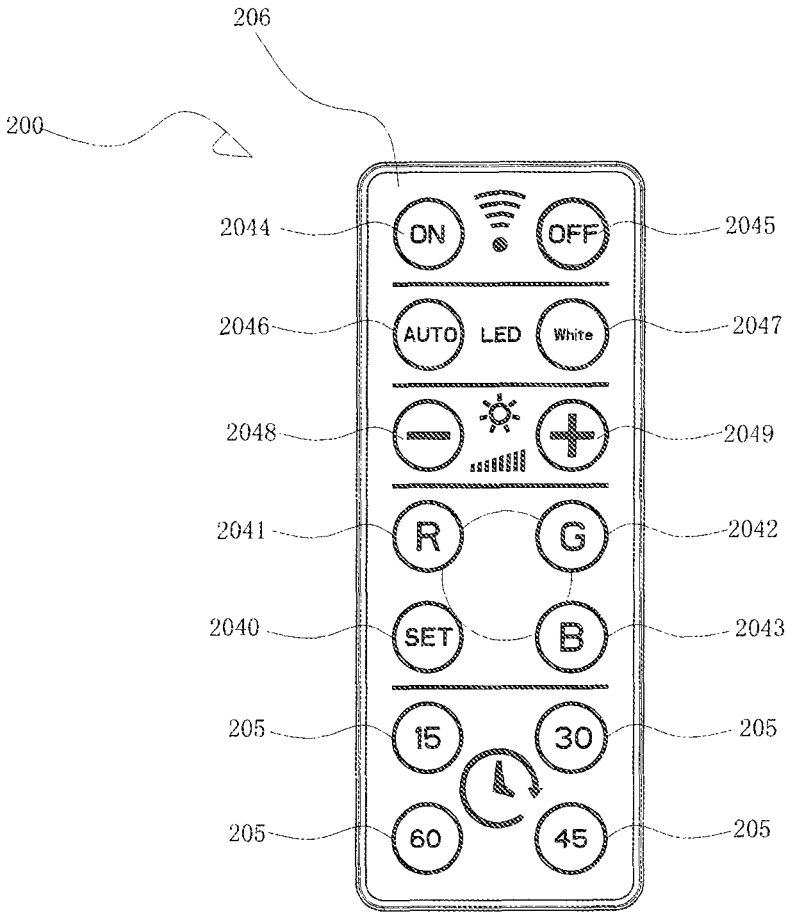
FIG. 5 is a front view of remote controller in Embodiment 1 of the present invention.
Figure 6:
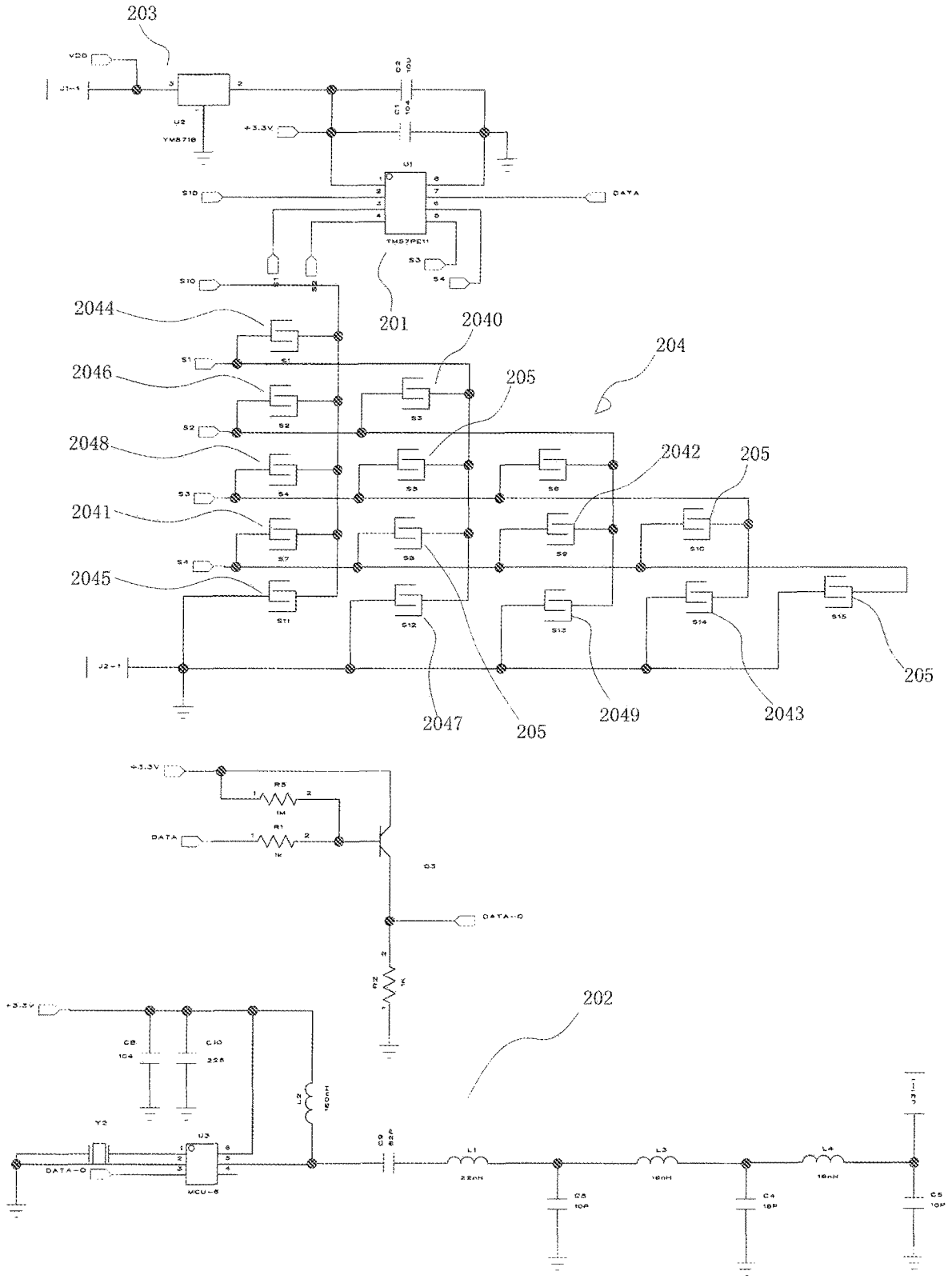
FIG. 6 is a circuit diagram of remote controller in Embodiment 1 of the present invention.

Embodiment 1: as shown in FIGS. 1-6, a user-defined festoon lamp component includes a festoon lamp 100 and a remote controller 200 adapted to the festoon lamp 100 for controlling the luminescent state of festoon lamp 100.

The festoon lamp 100 includes a first MCU 101 and a wireless receiving unit 102 electrically connected to the first MCU 101, a first power supply unit 103, a white light LED unit 104 and an RGB LED unit 105.

The festoon lamp 100 includes a lamp holder 1, a power supply 2 installed in the lamp holder 1 as the first power supply unit 103, a PCB 3 installed on lamp holder 1, several white light LEDs 4 installed on the upper end face of PCB 3 as white light LED unit 104 and a reflective cup 5 installed on the lamp holder 1 and fitted over the white light LEDs 4, a face cover 6 installed on the lamp holder 1 and covering the reflective cup 5 and a lamp shade 7 passing through the face cover 6 and contacting the upper end of reflective cup 5. The upper end face of the PCB 3 is provided with several RGB LEDs 8 interlaced with white light LEDs 4 as RGB LED unit 105. The first MCU 101 and wireless receiving unit 102 are installed on PCB 3. The power supply 2 supplies power to PCB 3 and white light LED 4, so that the white light LED 4 emits light, and the light ray is reflected by the reflective cup 5 and all irradiated outwards through the lamp shade 7, so as to implement lighting. In addition, the present invention adds RGB LED8 to the original LED lighting fixture to implement effect lighting to meet different operating requirements.

The power supply 2 includes a battery separator 21 installed in the lamp holder 1, a conducting sheet metal component 22 installed in the lamp holder 1 and located under the battery separator 21 and several batteries 23 electrically connected to the conducting sheet metal component 22. The PCB 3 is installed above the battery separator 21, and the halt switch 9 contacts the battery separator 21. The lower end of the lamp holder 1 is removably equipped with a battery cover 12 for convenient change of battery.

The PCB 3 is provided with a first LED driver module 33 for driving the white light LED 4 to emit light and the first, second and third LED driver modules 34, 35, 36 which jointly drive the RGB LED8 to emit different color lights or gradient color light.

The outer side of the reflective cup 5 is provided with several downbent elastic arms of force 51, the elastic arm of force 51 is provided with a sleeve joint part 52, the sleeve joint part 52 is fitted over a guide column 11 formed on the lamp holder 1. When the reflective cup 5 is pressed down, the elastic arm of force 51 is deformed to some extent to generate an upward resilience, when the lamp shade is released, the reflective cup 5 is restored under the resilience of elastic arm of force 51, and the lamp shade is restored accordingly. It is unnecessary to install a spring, the quantity of parts and components is reduced, the cost is reduce, and the assembly is more convenient, the structural stability can be guaranteed, so the present invention has relatively strong marketability. The sleeve joint part 52 is an unclosed sleeve joint collet, there is an opening in the periphery of the sleeve joint collet, the opening extends to the upper and lower ends of sleeve joint collet. The sleeve joint part 52 of this structure is more flexible, there will not be unsmooth slide resulted from fixed closed pore size.

An anti-disengagement flange 71 for preventing the lamp shade 7 from accidentally disengaging from the window 61 arranged in the face cover 6 for the lamp shade 7 to pass through is formed outside the lower end of the lamp shade 7.

The reflective cup 5 is provided with a wireless receiver 53, the wireless receiver 53 is connected to the PCB 3 by conductor, the wireless receiver 53 is connected to the wireless receiving unit 102. The face cover 6 is provided with a light conduction base 62, the wireless receiver 53 passes through the light conduction base 62.

The remote controller 200 includes a second MCU 201 and a wireless transmitting unit 202 electrically connected to the second MCU 201, a second power supply unit 203 and a button matrix unit 204 for controlling the luminescent state of the white light LED unit 104 and RGB LED unit 105. The festoon lamp 100 is electrically connected to the wireless transmitting unit 202 of the remote controller 200 through the wireless receiving unit 102. The button matrix unit 204 comprises an R button 2041 for independently increasing the R color in RGB LED unit 105, a G button 2042 for independently increasing the G color in RGB LED unit 105 and a B button 2043 for independently increasing the B color in RGB LED unit 105. The wireless receiving unit 102 communicates with wireless transmitting unit 202 through IR or RF.

The button matrix unit 204 includes an ON button 2044, an OFF button 2045, an AUTO button 2046, a White button 2047, a brightness− button 2048, a brightness+ button 2049, a SET button 2040 and several time setting buttons 205. The ON button 2044, OFF button 2045, AUTO button 2046, White button 2047, brightness− button 2048, brightness+ button 2049, SET button 2040 and several time setting buttons 205 and the R button 2041, G button 2042 and B button 2043 are arranged on the casing 206 of the remote controller 200.

To sum up, the present invention adds the RGB LED 8 to the original LED lighting fixture, so as to implement effect lighting to meet different operating requirements. In addition, the R button 2041, G button 2042 and B button 2043 on the remote controller can independently control the proportions of red, green and blue lights in the RGB LED unit 105, the user's favorite color light is assembled by free combination, the operation is very convenient and flexible, so that the present invention has very strong marketability. Moreover, the prepared adoption can be saved through the SET button 2040 for next or frequent use, the marketability of the present invention is further enhanced.

Embodiment 2

The difference of the Embodiment 2 from the aforethe Embodiment 1 is the specific structure of festoon lamp 100.

Figure 7:
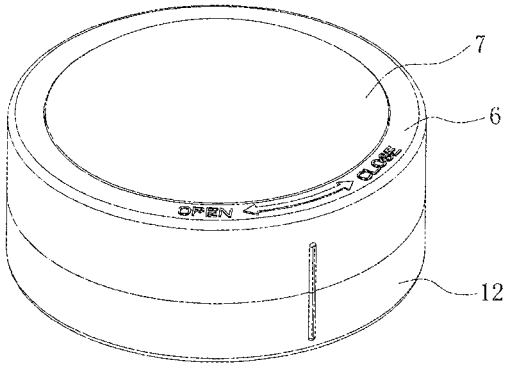
FIG. 7 is a stereogram of festoon lamp in Embodiment 2 of the present invention.
Figure 8:
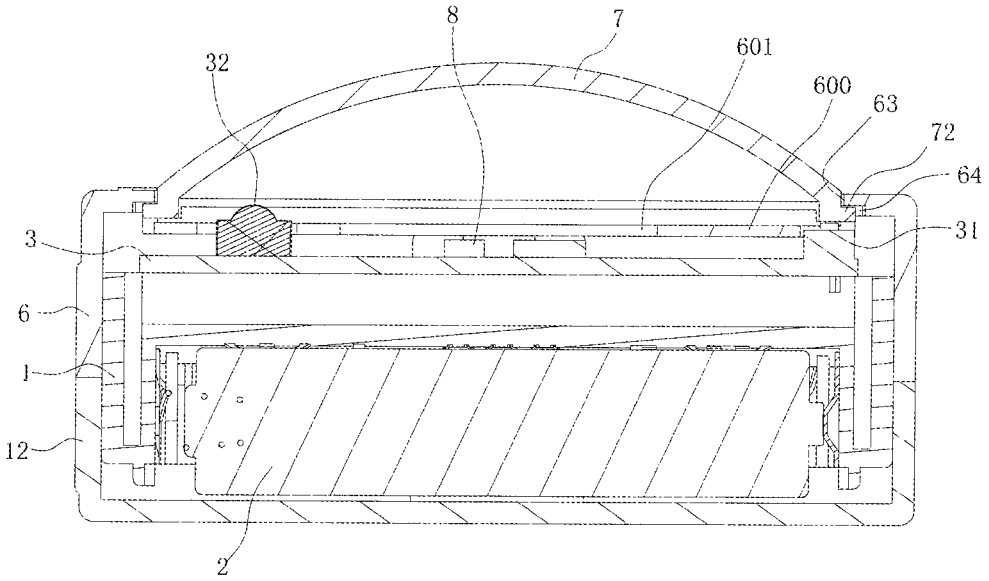
FIG. 8 is a sectional view of festoon lamp in Embodiment 2 of the present invention.
Figure 9:
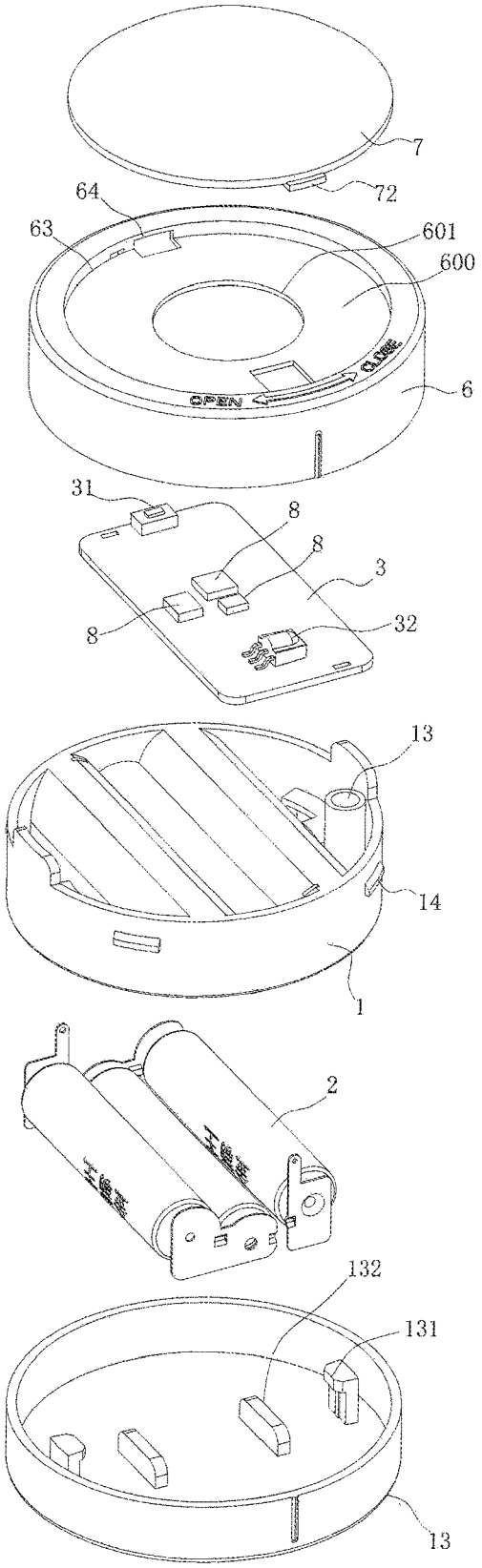
FIG. 9 is a three-dimensional exploded diagram of festoon lamp in Embodiment 2 of the present invention.
Figure 10:
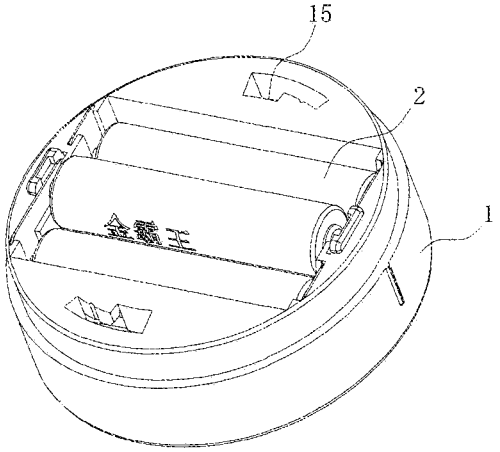
FIG. 10 is a stereogram after the bottom cover is removed from the festoon lamp in Embodiment 2 of the present invention.
Figure 11:
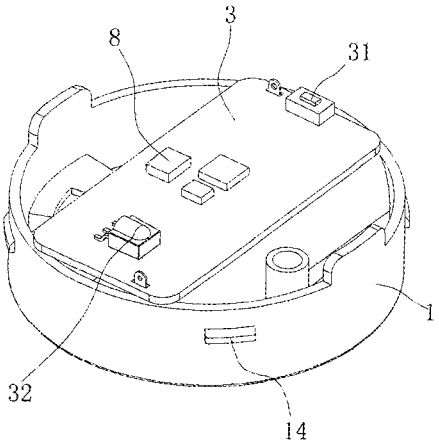
FIG. 11 is an assembly drawing of lamp holder and PCB of festoon lamp in Embodiment 2 of the present invention.
Figure 12:
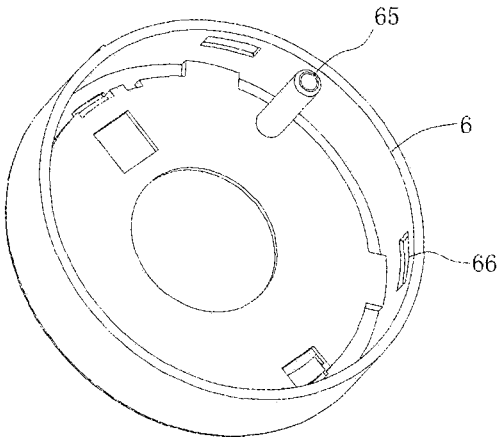
FIG. 12 is a stereogram of face cover in the festoon lamp in Embodiment 2 of the present invention.
Figure 13:
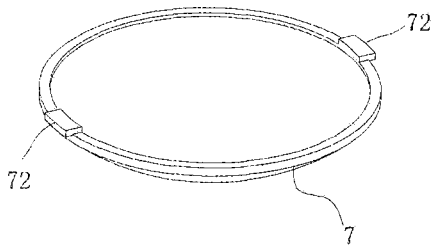
FIG. 13 is a stereogram of lamp shade in the festoon lamp in Embodiment 2 of the present invention.

As shown in FIGS. 7-13, the festoon lamp 100 includes a lamp holder 1, a power supply 2 installed in the lamp holder 1 as the first power supply unit 103, a PCB 3 installed on lamp holder 1, several RGB LEDs 8 installed on the upper end face of PCB 3 as the RGB LED unit 105, a face cover 6 buckled on the upper end of the lamp holder 1, a lamp shade 7 vertically movable on the face cover 6 and above the RGB LED8, and a bottom cover 13 installed on the lower end of the lamp holder 1. The PCB 3 is provided with a switch button 31. The side of the lamp shade 7 forms an anti-disengagement buckle 72 at the upper end of the switch button 31, when the lamp shade 7 is pressed, the anti-disengagement buckle 72 presses the switch button 31 to actuate the switch button 31. The upper end of the face cover 6 is integrated with an inner flange 600. The inner flange 600 has a window 601. The RGB LED 8 is placed in the window 601. The first MCU 101 and wireless receiving unit 102 are installed on PCB 3. In the Embodiment 2, the upper end of the face cover 6 is integrated with an inner flange 600. The inner flange 600 has a window 601, the RGB LED 8 is placed in the window 601. It replaces the reflective cup of the existing technology, so that the Embodiment 2 is free of the reflective cup stated in the Embodiment 1, the structure is simplified, the number of parts is reduced, the production cost is lower, and the assembly is easier. Moreover, the lamp shade 7 can be vertically movable on the upper end of the face cover 6, and the side of the shade 7 forms an anti-disengagement buckle 72 at the upper end of the switch button 31. When the lamp shade 7 is pressed, the anti-disengagement buckle 72 presses the switch button 31 to actuate the switch button 31. The operating area is large, so that the operation is more convenient, and it is unnecessary to install exposed switches, the esthetics of product shape is guaranteed.

The PCB 3 is provided with the first, second and third LED driver modules 34, 35, 36 which jointly drive the RGB LED 8 to emit different color lights or gradient color light.

The PCB 3 is provided with an IR sensor 32, the IR sensor 32 is located under the lamp shade 7, so that the IR sensor 32 can receive light signals through the lamp shade 7, it is unnecessary to install the light conduction base stated in the Embodiment 1, there are fewer parts, and the structure is simpler.

A storage slot 63 is formed in the upper end of the face cover 6, and an anti-disengagement hole 64 is formed in the inner wall of the storage slot 63. The storage slot 63 is located in the upper end of inner flange 600. The lamp shade 7 is installed in the storage slot 63, and an anti-disengagement buckle 72 is formed on the side face of the lamp shade 7, extending into the anti-disengagement hole 64, so that the lamp shade 7 is firmly installed in the storage slot 63, and it will not be disengaged from the face cover 6 by accident.

The face cover 6 covers the upper end of the lamp holder 1, the bottom cover 13 covers the lower end of the lamp holder 1, and the lower end face of the face cover 6 contacts the upper end face of the bottom cover 13, so that the lamp holder 1 is completely encased, its appearance is more orderly and esthetic.

A guide bar 65 is formed at the lower end of the face cover 6, a guide slot 13 is formed at the upper end of the lamp holder 1. The guide bar 65 is inserted into the guide slot 13, so that the face cover 6 can be firmly installed on the upper end of lamp holder 1.

A groove 66 is formed in the inner wall of the face cover 6, a barb 14 is formed on the outer wall of upper end of the lamp holder 1, the groove 66 engages with the barb 14, the assembly structure is simple and stable.

A rotary buckle 131 is formed on the bottom cover 13, a latching slot 15 adapted to the rotary buckle 131 is arranged in the lower end of the lamp holder 1, the assembly structure is simple and stable.

The power supply 2 is a battery, several support chips 132 are formed on the bottom cover 13, the support chips 132 hold the battery, so that the battery is firmly located in the lower end of lamp holder 1.

To sum up, in the Embodiment 2, an inner flange 600 is integrally formed at the upper end of the face cover 6, the inner flange 600 has a window 601, the RGB LED 8 is placed in the window 601. It replaces the reflective cup of the existing technology, so that the present invention is free of reflective cup, the structure is simplified, the number of parts is reduced, the production cost is lower, and the assembly is simpler. Moreover, the lamp shade 7 is vertically movable on the upper end of the face cover 6, and the side face of the shade 7 forms an anti-disengagement buckle 72 at the upper end of the switch button 31. When the lamp shade 7 is pressed, the anti-disengagement buckle 72 presses the switch button 31 to actuate the switch button 31, the operating area is large, the operation is more convenient, and it is unnecessary to arrange exposed switches, the esthetics of product shape is guaranteed.

I claim:

1. A user-defined festoon lamp component comprising: a festoon lamp (100) and a remote controller (200) adapted to the festoon lamp (100) for controlling the luminescent state of festoon lamp (100), wherein the festoon lamp (100) includes a first MCU (101), a wireless receiving unit (102) electrically connected to the first MCU (101), a first power supply unit (103), a white light LED unit (104), and an RGB LED unit (105);

wherein the remote controller (200) includes a second MCU (201), a wireless transmitting unit (202) electrically connected to the second MCU (201), a second power supply unit (203), and a button matrix unit (204) for controlling the luminescent state of the white light LED unit (104) and RGB LED unit (105), the festoon lamp (100) is electrically connected to the wireless transmitting unit (202) of the remote controller (200) through the wireless receiving unit (102);

the button matrix unit (204) includes an R button (2041) for independently increasing the R color in RGB LED unit (105), a G button (2042) for independently increasing the G color in RGB LED unit (105), and a B button (2043) for independently increasing the B color in RGB LED unit (105);

wherein the button matrix unit (204) includes an ON button (2044), an OFF button (2045), an AUTO button (2046), a White button (2047), a brightness− button (2048), a brightness+ button (2049), a SET button (2040) and several time setting buttons (205), the ON button (2044), OFF button (2045), AUTO button (2046), White button (2047), brightness− button (2048), brightness+ button (2049), SET button (2040) and several time setting buttons (205) and the R button (2041), G button (2042) and B button (2043) are arranged on the casing (206) of the remote controller (200);

wherein the festoon lamp (100) includes a lamp holder (1), a power supply (2) installed in the lamp holder (1) as the first power supply unit (103), a PCB (3) installed on the lamp holder (1), a plurality of white light LEDs (4) installed on an upper end face of PCB (3) as white light LED unit (104), a reflective cup (5) installed on the lamp holder (1) and fitted over the white light LEDs (4), a face cover (6) installed on lamp holder (1) and covering the reflective cup (5), and a lamp shade (7) passing through the face cover (6) and contacting an upper end of reflective cup (5), the upper end face of the PCB (3) is provided with several RGB LEDs (8) interlaced with white light LEDs (4) as RGB LED unit (105), the first MCU (101) and wireless receiving unit (102) are installed on PCB (3).

2. The user-defined festoon lamp component defined in claim 1, wherein the PCB (3) is provided with a first LED driver module (33) for driving the plurality of white LEDs (4) to emit light and first, and third driver modules (34, 35, 36) for jointly driving the RGB LED (8) to emit different color lights or gradient color light.

3. The user-defined festoon lamp component defined in claim 1, wherein an outer side of the reflective cup (5) is provided with a plurality of downbent elastic arms of force (51), the elastic arms of force are (51) is provided with a sleeve joint part (52), the sleeve joint part (52) is fitted over a guide column (11) formed on the lamp holder (1); wherein the sleeve joint part (52) is an unclosed sleeve joint collet, there is an opening in the periphery of the sleeve joint collet, the opening extends to the upper and lower ends of the sleeve joint collet.

4. The user-defined festoon lamp component defined in claim 3, wherein an anti-disengagement flange (71) for preventing the lamp shade (7) from accidentally disengaging from a window (61) in the face cover (6) for the lamp shade (7) to pass through is formed outside a lower end of the lamp shade (7).

5. The user-defined festoon lamp component defined in claim 3, wherein the reflective cup (5) is provided with a wireless receiver (53), the wireless receiver (53) is connected to the PCB (3) by conductor, the wireless receiver (53) is connected to the wireless receiving unit (102), the face cover (6) is provided with a light conduction base (62), the wireless receiver (53) passes through the light conduction base (62).

6. The user-defined festoon lamp component defined in claim 1, wherein the festoon lamp (100) includes the lamp holder (1), the power supply (2) installed in the lamp holder (1) as the first power supply unit (103), the PCB (3) installed on the lamp holder (1), several RGB LEDs (8) installed on the upper end face of PCB (3) as the RGB LED unit (105), the face cover (6) buckled in an upper end of the lamp holder (1), the lamp shade (7) vertically movable on the face cover (6) and above the RGB LED (8), a bottom cover (13) installed at a lower end of the lamp holder (1), the PCB (3) is provided with a switch button (31), the side face of the lamp shade (7) forms an anti-disengagement buckle (72) at an upper end of the switch button (31), when the lamp shade (7) is pressed, the anti-disengagement buckle (72) presses the switch button (31) to actuate the switch button (31), an inner flange (600) is integrally formed at an upper end of the face cover (6), the inner flange (600) has a window (601), the RGB LD (8) is placed in the window (601), the first MCU (101) and wireless receiving unit (102) are installed on the PCB (3).

7. The user-defined festoon lamp component defined in claim 6, wherein the PCB (3) is provided with an IR sensor (32) as the wireless receiving unit (102), the IR sensor (32) is located under the lamp shade (7), the face cover (6) covers the upper end of the lamp holder (1), the bottom cover (13) covers the lower end of the lamp holder (1), and a lower end face of the face cover (6) contacts an upper end face of the bottom cover (13).

8. The user-defined festoon lamp component defined in claim 6, wherein a storage slot (63) is formed in the upper end of the face cover (6), and an anti-disengagement hole (64) is formed in the inner wall of the storage slot (63), the storage slot (63) is located in an upper end of inner flange (600), the lamp shade (7) is installed in the storage slot (63), and an anti-disengagement buckle (72) formed on the side face of the lamp shade (7) is inserted into the anti-disengagement hole (64), a guide bar (65) is formed at the lower end of the face cover (6), a guide slot (13) is formed at the upper and of the lamp holder (1), the guide bar (65) is inserted into the guide slot (13).

* * * * *